US006846382B1

(12) United States Patent
Scott et al.

(10) Patent No.: US 6,846,382 B1
(45) Date of Patent: Jan. 25, 2005

(54) NONWOVEN WEB MATERIAL FOR INFUSION PACKAGING AND METHOD OF MAKING SAME

(75) Inventors: Peter C. Scott, Enfield, CT (US); Helen Viazmensky, Avon, CT (US)

(73) Assignee: Ahlstrom Windsor Locks, LLC, Windsor Locks, CT (US)

( * ) Notice: Subject to any disclaimer, the term of this patent is extended or adjusted under 35 U.S.C. 154(b) by 506 days.

(21) Appl. No.: 09/018,216

(22) Filed: Feb. 4, 1998

(51) Int. Cl.[7] ..... D21F 11/00; B65B 29/02

(52) U.S. Cl. ..... 162/91; 162/98; 162/141; 162/213; 426/77; 426/84; 428/316.6

(58) Field of Search ..... 426/77, 79, 84; 428/316.6; 162/98, 91, 141, 213

(56) References Cited

U.S. PATENT DOCUMENTS

| | | | | | |
|---|---|---|---|---|---|
| 2,157,656 | A | | 5/1939 | Doble | 99/77.1 |
| 2,414,833 | A | | 1/1947 | Osborne | 92/39 |
| 2,531,594 | A | * | 11/1950 | Abrahams | 426/84 |
| 2,928,765 | A | | 3/1960 | Kurjan | 162/129 |
| 3,183,096 | A | * | 5/1965 | Hiscock | 426/84 |
| 3,386,834 | A | * | 6/1968 | Noiset et al. | 426/84 |
| 3,529,925 | A | * | 9/1970 | Thomas et al. | 426/77 |
| 3,640,727 | A | * | 2/1972 | Heusinkveld | 426/77 |
| 4,218,286 | A | | 8/1980 | Jones et al. | 162/164 |
| 4,666,390 | A | | 5/1987 | Kenworthy et al. | 425/86 |
| 4,801,464 | A | * | 1/1989 | Hubbard, Jr. | 426/79 |
| 4,976,858 | A | | 12/1990 | Kadoya | 210/496 |
| 5,288,402 | A | | 2/1994 | Yoshida | 210/488 |
| 5,443,606 | A | | 8/1995 | Hassenboehler, Jr. et al. | 55/486 |
| 5,496,573 | A | * | 3/1996 | Tsuji et al. | 426/84 |
| 5,500,167 | A | | 3/1996 | Degen | 264/41 |
| 5,609,947 | A | | 3/1997 | Kamei et al. | 428/212 |
| 5,780,369 | A | * | 7/1998 | Allison et al. | 442/384 |
| 6,139,883 | A | * | 10/2000 | Gbur et al. | 426/77 |

FOREIGN PATENT DOCUMENTS

| | | | |
|---|---|---|---|
| CA | 651488 | * | 10/1962 |
| DE | 2636486 | * | 8/1976 |
| WO | WO 97/04956 A1 | | 2/1997 |
| WO | WO 9709167 A1 | | 3/1997 |

* cited by examiner

*Primary Examiner*—Nina Bhat
(74) *Attorney, Agent, or Firm*—Alix, Yale & Ristas, LLP

(57) ABSTRACT

A multi-phase, non-heat seal tea bag web material is provided with a pattern on either the top or bottom phases. The top phase is formed from fibers, such as hardwood, that provide a tighter or more dense fibrous phase than the vegetable fibers used in the base phase. Patterning can be provided during web formation by using a knuckled wire or by applying a fluid jet against the top of the web material. The sifting characteristics of the multi-phase web material are comparable to or better than that exhibited by single phase material.

1 Claim, No Drawings

NONWOVEN WEB MATERIAL FOR INFUSION PACKAGING AND METHOD OF MAKING SAME

FIELD OF THE INVENTION

The present invention relates generally to fibrous web material intended for use as infusion packages for brewing beverages such as tea, coffee and the like. It is more particularly concerned with a new and improved multi-phase non-heat seal nonwoven web material having a patterned appearance.

BACKGROUND OF THE INVENTION

Infusion packages for brewing beverages, such as tea bags and coffee bags, are generally produced from either "heat seal" or "non-heat seal" fibrous nonwoven web material. Heat seal webs generally comprise two layers or phases. One of these two layers includes fusible polymeric fibers which allow the web to be heat sealed to itself in the production of infusion bags. The other layer is present as an insulation layer to prevent polymer sticking to heated dies during conversion of the web to produce an infusion package. In contrast, a non-heat seal paper, which normally has a basis weight in the range of 9 to 18 g/m$^2$, and typically about 12.3 g/m$^2$ is generally comprised of a single layer comprised of vegetable fibers and does not incorporate fusible polymeric fibers. Thus, as its name suggests, non-heat seal webs cannot be heat sealed to themselves. Infusion bags are produced from such material by crimping or otherwise mechanically securing two portions of the material together.

There is however a problem is some areas with conventional non-heat seal materials for use in the production of tea bags in that fine particles of tea or tea dust resulting from interaction of tea leaves during processing have a tendency to pass or sift through the web material to the outside of the tea bag. Since tea bags are generally packaged in boxes or other types of "outer" packaging, the fine tea particles or dust are "loose" in the packaging and this is undesirable from an aesthetic viewpoint.

One possibility of overcoming this problem would be to increase the percentage of finer fibers, such as hardwood fibers, in the stock from which the single ply nonwoven web material is produced. This would result in a nonwoven with smaller pores, thus reducing the amount of fine tea or tea dust which can sift through the web. The increase of hardwood fibers or other short fibers in the single layer to achieve the required pore size distribution would, however, affect overall strength to the extent that the web would not have sufficient strength for manufacture into infusion bags. A further disadvantage which would be associated with the use of hardwood fibers would be the incidence of pin-hole generation through air entrainment.

A further disadvantage of conventional non-heat seal material is that it is difficult to provide a pattern in the web using conventional methods. The patterns which are desired are those which can readily be produced in nonwovens of the "heat seal" type. Such patterns may comprise a matrix of perforations or semi-perforations which are formed through the web and which are intended to allow the passage of water therethrough. Alternatively, the pattern may be either a logo or other marking indicating the manufacture of either the nonwoven or the infusion packets prepared therefrom.

Such perforations are generally formed in heat seal nonwovens by one of two methods. Firstly, the perforations may be formed by a pattern of projections known as knuckles on the forming wire of the papermaking machine on which the fibrous suspension used for producing the paper is produced during the "wet laying" operation. Secondly, the pattern may be formed in the web by fluid jets directed onto the formed web.

Non-heat seal nonwoven webs are generally comprised of a single layer and typically have a basis weight of 12.3 g/m$^2$. The patterning methods discussed above is not generally used for such non-heat seal webs. Thus, if the web is formed on a wire provided with knuckles, it cannot be easily released from the wire. This is believed to be due to the fact that the cellulosic fibers of the web are more cohesive because of their greater contact with the wire and their wetness, and as such are more difficult to release than the cylindrical synthetic fibers used in heat seal nonwoven materials. If a liquid jet is used to pattern such a non-heat seal web, the resultant material is too "open" as the jet tends to "strike through" the single layer and allow beverage precursor material, such as tea leaves, to pass or sift through the web material.

DESCRIPTION OF THE INVENTION

It is therefore an object of the present invention to obviate or mitigate the above-mentioned disadvantages.

According to one aspect of the present invention, there is provided a fibrous, porous nonwoven web material of the non-heat seal type having a basis weight of 9 to 18 g/m$^2$ and comprising a first layer and a second layer juxtaposed thereto wherein the second layer has a smaller pore size than the first layer. Included in this aspect of the present invention is the is provision for a beverage infusion bag comprising a beverage precursor material enclosed within a packet formed of this material.

The web material of the invention is such that it is capable for reducing or inhibiting passage therethrough of fine particles of a beverage precursor material, such as tea leaves, and such that it has the required strength and infusion for conversion to beverage infusion bags. The invention thus provides a non-heat seal material which may be converted to tea bags from which there is comparable and preferably minimal sifting or passage of fine particles from the bags. Of course, the reduction in porosity as provided by the second layer should not be so high as to prevent passage of water through the material during infusion of the beverage.

The material of the invention also has the advantage that it may be patterned by means of a knuckled wire or fluid jets, as detailed more fully below.

Other objects will be in part obvious and in part pointed out more in detail hereinafter.

These objects are achieved by providing a fibrous, porous non-woven web material of the non-heat seal type having a basis weight of 9 to 18 g/m$^2$ and comprising a first layer and a second layer juxtaposed thereto wherein the second layer is tighter, that is with a smaller pore size than the first layer. The method of the present invention further involves producing a patterned paper of the non-heat seal type comprising wet laying a first fibrous layer and subsequently a second layer thereon, and forming a pattern in the wet laid web during the paper forming step while the web is on the papermaking fabric or forming wire.

A better understanding of the features of construction, combination of elements and arrangement of parts, as well as the several steps of the process together with the relation of one or more of such steps with respect to each of the others and the article processing the features, properties and relation of elements of the invention will be obtained from the following detailed description that sets forth illustrative embodiments and is indicative of the way in which the principles of the invention are employed.

DESCRIPTION OF A PREFERRED EMBODIMENT

As mentioned, the invention is primarily concerned with multiphase sheet material and particularly with multi-phase water laid material produced in accordance with the conventional paper making techniques. In this connection, numerous different techniques have been employed herefore to make the multi-phase fibrous webs. Typical of those found most useful in the production of infusion web materials is the dual headbox technique described in U.S. Pat. No. 2,414,833. In accordance with that process, a suspension of non-heat seal fibers flow through a primary headbox and continuously deposit as a base phase on an inclined web-forming wire screen. The material for the top or second phase is introduced into the primary headbox at a location immediately after or at the point of deposition of the base phase on the inclined wire. This may be carried out by means of an inclined trough or by a secondary headbox in such a manner that the top phase fibers co-mingle slightly with the base fibers flowing through the primary headbox. In this way, the base fibers have a chance to provide a base mat or phase, prior to the deposition of the second or top phase. As is appreciated, the latter is secured to the base phase by an interface formed by the intermingling of the particles within the aqueous suspensions. Typically, sheets produced in this manner have non-heat seal fibrous covering the entire surface area of the sheet material on the surface in contact with the inclined fiber collecting screen while the top of the sheet material has a mixture of fibers with the top phase fibers greatly predominating. In this way there is not a clear line of demarcation between the two phases of the multi-phase sheet material; yet there is a predominance of top phase fibrous material on the top surface or top phase of the multi-phase sheet. The center or interface boundary, of course, is composed of a mixture of the two different types of fibers.

Although the technique or process described in the aforementioned U.S. Pat. No. 2,414,833 is preferably followed, the material used in preparing the top phase of the sheet material is different. It is comprised of hardwood fibers. The two phase production method has an advantage in that any voids in the first layer caused by air entrainment will be filled as a result of drainage through the voids by the hardwood fiber layer of reduced porosity. There is the further advantage of the two phase process in that for a material of a particular basis weight it allows an increased speed of production as compared to the production of a single layer material of the same basis weight.

While the second layer may be produced in a number of ways to ensure that it has a pore size lower than the first layer, in a preferred embodiment of the invention, the second layer is produced from hardwood fibers which are shorter and finer than the vegetable fibers of the first layer. Alternatively, it is possible for the second layer to comprise fibers which are coarser than those of the first layer and to be used in an amount such as to provide a highly tortuous path along which a particle would need to pass to traverse the second layer. It is this highly tortuous path which provides the required small pore size.

As indicated, it is preferred that the majority of the fibers from which the second layer is formed have a mean cross-sectional size and/or length less than those of the first layer.

Preferably the fibers in the second layer provide 10 to 50% by weight of the total weight of the web material. In a preferred material in accordance with the invention, the first layer comprises vegetable fibers and the second layer comprises hardwood fibers.

The hardwood fibers of the second layer may for example comprise 10% to 50%, preferably 20% to 40%, by weight of the total weight of the web material. The hardwood fibers preferably have a length of 0.4 mm to 2.5 mm and may for example have a mean length of about 0.8 mm. The fiber width may be 10 to 25 microns with a mean of about 14 microns. Hardwood fibers are finer and shorter than softwood fibers. Examples of hardwood fibers which may be used include birch, beech and, preferably, eucalyptus. If desired, the second layer may comprise softwood, sisal and/or jute or manmade fibers as part of the fiber components of the layer.

Although it is preferred that the second layer comprises hardwood fibers, it is possible for the second layer to be comprised of other fiber types.

Preferably the vegetable fibers of the first layer provide 50% to 90%, more preferably 50% to 70%, by weight of the web material. These fibers will generally have a length of 0.8 mm to 9 mm and may for example have a mean length of about 4.3 mm. A suitable vegetable fiber is manila hemp or abaca.

If desired, the first layer may comprise sisal and/or jute as part of the vegetable fiber component of the layer. It may also be possible to produce a similar material with manmade fibers, although the preferred a method would be as described above.

If desire, a proportion of the vegetable fibers of the first layer may be replaced by softwood fibers. Preferably the amount of softwood fibers does not exceed 75% by weight of the first layer. Softwood fibers are long, flat ribbon-like fibers which are readily distinguished by a person skilled in the art from vegetable fibers and hardwood fibers. The softwood fibers may have a length of 0.8 mm to 5 mm and a width of 12 to 60 microns. Typical means of these values are 3.8 mm and 29 microns respectively. The softwood fibers may for example be obtained from spruce, pine, cedar, western hemlock, fir or redwood.

It is preferred that the web material of the invention has a thickness in the range of 30 to 100 $\mu$m, more typically in the region of 40 to 60 $\mu$m. The material of the invention preferably has a basis weight of 9 to 15 g/m$^2$, more preferably 9 to 14 g/m$^2$, even more preferably 11 to 13 g/m$^2$, and most preferably 12 to 13 g/m$^2$. Typically the basis weight will be 12.3 to 12.4 g/m$^2$.

It should be appreciated that the invention also covers webs comprising three or more layers. Thus, it is possible in accordance with the invention to produce a nonwoven having a central layer, comprised of softwood fibers sandwiched between an outer layer comprised of manila hemp fibers and another outer layer comprised of hardwood fibers. The layer comprised of hardwood fibers would have the smallest pore size whereas the layer comprises of hemp fibers may have a larger pore size than the layer comprised of softwood fibers or vice versa. This construction may be modified so that the layer comprised of hemp fibers is the central layer and the layer comprised of softwood fibers forms an outer layer.

The material of the invention also has the advantage that it may be patterned by means of a knuckled wire or fluid jets during the forming step on the papermaking fabric or wire.

Such techniques are disclosed in greater detail in Kenworthy et al U.S. Pat. No. 4,582,666 issued Apr. 15, 1986 and U.S. Pat. No. 4,666,390 issued May 19, 1987, the disclosures of which are incorporated herein by reference.

If the material comprises only two layers and the fibers of the second layer are shorter and finer than those of the first layer, then the pattern is formed in the first layer by the knuckle wire technique or in the second layer of the material using the fluid jet technique of U.S. Pat. No. 4,666,390. This is an important feature since the shorter fibers of the second layer provide good pattern definition because of their lower cohesiveness and greater ease of movement than the longer fibers of the first layer which provide strength during processing.

The ability to provide patterns in non-heat seal papers is an important aspect of the present invention in its own right and therefore there is provided a method of producing a patterned paper of the non-heat seal type comprising wet laying a first fibrous layer and subsequently a second layer thereon, and forming a pattern in the wet laid web during the paper forming step while the web is on the papermaking fabric or wire.

As mentioned, the web material is formed from two fibrous stocks. One stock for forming the first layer comprises vegetable fibers, and optionally other fiber types, e.g., softwood fibers, and the other stock for forming the second or top layer comprises hardwood fibers and optionally other fiber types.

As mentioned one of the factors associated with the new and improved technique of the present invention is the utilization of fiber collecting or paper forming elements which are knuckled and coarser than those normally used in manufacturing papers having the basis weights exhibited by the products of the present invention. As is known, the standard Fourdrinier screens are typically fine wire members and have about 60–100 strands per inch in each direction with the strands having a thickness or diameter of about 0.006 inch. The screening elements used in accordance with the present invention are cabled wires and are below the typical 75 mesh of Fourdrinier screens and in fact are about 45 mesh or more and preferably about 50 mesh in one direction. Additionally, the thickness of the solid areas is at least twice that of the Fourdrinier screen. The coarse paper forming screens or wires, such as the so-called "cabled" or "twisted cable" type or the plastic screens, are generally preferred. These have larger strand thicknesses resulting in drainage openings generally having an average hole area about 2 to 60 times greater than the approximately $0.95\times10^4$ square inch area of the Fourdrinier screen openings. It will be appreciated that the exact screen type and size utilized will vary depending on the desired product, the type, denier and length of fiber used in the furnish, the consistency of the furnish as well as the viscosity of the suspending fluid and the amount of vacuum applied during web formation. Quite naturally, and in fact preferably, the open or coarse knuckled screens tend to result in an undulating web configuration which also adds to the apparent bulk and loft of the nonwoven material and is believed to impart improved hand, drape and appearance to the resultant product. The open, coarse configuration of the screen permits greater laminar flow of the dispersing fluid through the apertures of the foraminous fiber collecting element during web formation so as to drive the fibers into the orientation required for producing the desired patterned configuration. At the same time, the size of the openings in the screen should not be so great that the fibers within the fiber dispersion are not retained or "hung-up" on the screen during the web forming processes and the size of the solid areas should not be so great as to interfere with the drainage of the fiber dispersion. The precise size required is one which is large enough to provide the required fluid flow during drainage but small enough to permit the requisite fiber collection as the fiber dispersing medium passes rapidly through the screen.

The resultant web may be passed around steam heat drying cylinders or other drying means such as gas heated through dryers and may be subjected to further impregnation with additive at a size press. Wet or dry strength agents may be added either in the head box or the size press. As an example, the materials described in Jones et al U.S. Pat. No. 4,218,286 issued Aug. 19, 1980, may be employed.

"Infusion" refers to the rate at which water can pass into the tea bag and tea liquor can pass out of the tea bag as well as the degree of extraction which is able to take place within a specified time. This is usually reported in terms of "first color" and "percent transmittance", respectively. When testing for first color, a tea bag made from the material to be tested is carefully placed in quiet distilled water after the water has been brought to a boil. Using a stopwatch, the time is recorded at which the first amber stream appears at the bottom of the sample. A first color time of about 5–6 seconds is considered indicative of good infusion characteristics. The percent transmittance test is conducted by measuring the transmittance of the brew after a 60 second steep time using a Markson Colorimeter Model T-600 at a wavelength of 530 mμ and using a 1 cm cell. A target value for good infusion is in the mid-sixty percentile range with transmittance decreasing an infusion improves.

The following examples are given in order that the effectiveness of the present invention may be more fully understood. The examples are set forth for the purpose of illustration only and are not intended in any way to limit the practice of the invention. All parts are given by weight.

Example I

A two phase non-heat seal nonwoven web material was made on a knuckled fiber collecting wire of an inclined wire papermaking machine and compared with a comparable single phase web. For both webs, the machine was fitted with a 82×48 mesh fiber collecting wire. For the top phase, a fiber furnish of 100% eucalyptus fibers was prepared while the furnish for the bottom or base phase consisted of two-thirds refined kenaf and one-third Philippine hemp fibers. For the single phase sheet, equal amounts of eucalyptus and kenaf were used together with half that amount of hemp. Nonwoven sheet materials were formed at a basis weight of about 13 g/m$^2$. Both sheets exhibited a satisfactory pattern.

A comparison of these materials with a commercially available heat seal tea bag is set forth in the following Table 1.

TABLE 1

| | Units | Single Phase | Two Phase | Tetley Round Bag |
|---|---|---|---|---|
| Basis Weight | g/m$^2$ | 13.39 | 12.24 | 16.50 |
| Porosity | l/min. | 1053 | 1214 | 817 |
| Thickness | microns | 70.5 | 61.75 | 76.2 |
| Tensile - MD | g/25 mm | 1976 | 1728 | — |
| Tensile - CD | g/25 mm | 699 | 673 | — |
| Elongation - MD | % | 1.55 | 1.5 | — |
| Elongation - CD | % | 6.8 | 6.3 | — |
| Toughness - MD | g-cm/cm$^2$ | 8.35 | 7.0 | — |

TABLE 1-continued

| | Units | Single Phase | Two Phase | Tetley Round Bag |
|---|---|---|---|---|
| Toughness - CD | g-cm/cm$^2$ | 15.9 | 13.1 | — |
| Sifting | % | 41.9 | 47.3 | 81.6 |
| First Color | seconds | 6.21 | 8.03 | 6.8 |
| Transmittance | % | 49.2 | 50.5 | 47.7 |

As can be seen, the single phase and two phase sheets exhibited comparable physical properties while the sifting characteristics of these sheets were significantly improved relative to the commercial heat seal tea bag. The infusion characteristics of the two phase material was slightly poorer than both the single phase and the commercial product.

Example II

The procedure of Example I was repeated using a different knuckled wire, that is a wire having a 55×50 mesh. As seen in Table 2, the basis weight was slightly higher but this wire resulted in significant improvement in the sifting property of the two phase material.

TABLE 2

| | Units | Single Phase | Two Phase |
|---|---|---|---|
| Basis Weight | g/m$^2$ | 13.15 | 13.51 |
| Porosity | l/min. | 1163 | 1138 |
| Thickness | microns | 66.2 | 64.8 |
| Tensile - MD | g/25 mm | 1645 | 1944 |
| Tensile - CD | g/25 mm | 808.5 | 704 |
| Elongation - MD | % | 1.5 | 1.3 |
| Elongation - CD | % | 5.7 | 7.5 |
| Toughness - MD | g-cm/cm$^2$ | 6.4 | 6.1 |
| Toughness - CD | g-cm/cm$^2$ | 14.9 | 17.5 |
| Sifting | % | 52.3 | 23.5 |
| First Color | seconds | 7 | 6.5 |
| Transmittance | % | 40.7 | 46.2 |

Example III

A two phase non-heat seal nonwoven web material was made using a standard Fourdrinier wire on an inclined wire papermaking machine. The fiber furnish for the base phase consisted of 60% hemp, 20% kenaf and 20% softwood pulp. The top phase was 100% eucalyptus fibers. The target weight for the base phase was 7.5 g/m$^2$ and for the top phase was 4 g/m$^2$.

After forming the web material and while it was still on the forming wire, it was subject to a water jet patterning applied to the top of the web according to the procedure of U.S. Pat. No. 4,582,666. The patterning was in the form of a company name and logo and was quite satisfactory. The properties of the resultant web material are set forth in Table 3.

TABLE 3

| | Units | Fluid Jet Patterned |
|---|---|---|
| Basis Weight | g/m$^2$ | 14.25 |
| Porosity | l/min. | 954 |
| Thickness | microns | 58 |
| Tensile - MD | g/25 mm | 2199 |
| Tensile - CD | g/25 mm | 919 |
| Elongation - MD | % | 2.1 |
| Elongation - CD | | 6 |
| Toughness - MD | g-cm/cm$^2$ | 12 |
| Toughness - CD | g-cm/cm$^2$ | 17.8 |
| Sifting - Sand 75–106 microns | % | 18.4 |
| Sifting - Sand 106–150 microns | % | 7.025 |

As will be apparent to persons skilled in the art, various modification, adaptations and variations of the foregoing specific disclosure can be made without departing from the teaching of the present invention.

We claim:

1. A method of producing a patterned paper of the non-heat seal type comprising wet laying a first fibrous layer on a paper forming wire and subsequently a second layer thereof and forming a pattern in the wet-laid web during the paper forming step while the web is on the paper forming wire wherein the paper forming wire is a knuckle wire.

* * * * *